US005686693A

United States Patent [19]

Jakobsson

[11] Patent Number: 5,686,693

[45] Date of Patent: Nov. 11, 1997

[54] SOFT STEEL PROJECTILE

[76] Inventor: Bo Jakobsson, Pråmgatan 6, S-733 35, Sala, Sweden

[21] Appl. No.: 600,301

[22] Filed: Feb. 12, 1996

Related U.S. Application Data

[63] Continuation-in-part of Ser. No. 363,405, continuation of PCT/SE93/00563 filed on Jun. 23, 1993 now WO94/00730, abandoned.

[30] Foreign Application Priority Data

Jun. 25, 1992 [SE] Sweden ..... 9201967

[51] Int. Cl.[6] ..... F42B 12/72

[52] U.S. Cl. ..... 102/501; 102/514; 102/515; 102/524

[58] Field of Search ..... 102/501, 511, 102/514–518, 529, 524, 526, 527; 420/84

[56] References Cited

U.S. PATENT DOCUMENTS

| | | | |
|---|---|---|---|
| 1,582,673 | 4/1926 | Fahrenwald | 102/524 |
| 1,732,211 | 10/1929 | Olin et al. | 102/514 |
| 1,769,263 | 7/1930 | Johnson . | |
| 1,944,884 | 1/1934 | Gerlich | 102/514 |
| 2,303,449 | 12/1942 | Flerschmann | 102/514 |
| 2,336,143 | 12/1943 | Werme | 102/514 |
| 2,868,130 | 1/1959 | Gulley et al. | 102/501 |
| 3,152,889 | 10/1964 | Holowaty | 420/84 |
| 3,154,016 | 10/1964 | Frey | 102/501 |
| 3,365,922 | 1/1968 | Conces et al. | 420/84 |
| 3,431,612 | 3/1969 | Darigo et al. | 102/514 |
| 4,040,875 | 8/1977 | Nable | 148/35 |
| 4,109,581 | 8/1978 | Six | 102/501 |
| 4,387,492 | 6/1983 | Inman | 102/514 |
| 5,079,814 | 1/1992 | Moore et al. | 102/509 |
| 5,264,022 | 11/1993 | Haygarth et al. | 102/501 |

FOREIGN PATENT DOCUMENTS

| | | | |
|---|---|---|---|
| 336272 | 3/1904 | France | 102/514 |
| 829623 | 7/1938 | France . | |
| 3104234 | 2/1982 | Germany . | |
| WO86/04135 | 7/1986 | WIPO | 102/515 |

*Primary Examiner*—Harold J. Tudor
*Attorney, Agent, or Firm*—Fasth Law Firm

[57] ABSTRACT

The projectile is made of a virtually lead free steel alloy containing tellurium. This projectile is more environmentally safe compared to conventional lead bullets. The tellurium in combination with a small amount of lead provides a steel alloy having a high machinability and good lubrication properties, thus reducing frictional wear inside a rifle bore when the bullet is passed therethrough. Additionally, a thin anticorrosive coating may be applied on the bullet. The coating may comprise a metal selected from the group consisting of copper, zinc and nickel. An additional lubricating coating comprising polytetrafluoroethylene may also be applied on the projectile. The projectile has a grooved guide section that is permitted to be deformed by the rifle bore without destroying the rifle bore when the projectile is fired in a rifle.

11 Claims, 4 Drawing Sheets

SOFT STEEL PROJECTILE

PRIOR APPLICATION

This is a continuation-in-part application of U.S. patent application Ser. No. 08/363,405 filed on 22 Dec. 1994 now abandoned which is a continuation-in-part of PCT/SE93/00563, filed on Jun. 23, 1993, now WO 94/00730.

FIELD OF THE INVENTION

This invention relates to a projectile or bullet for firearms.

BACKGROUND AND SUMMARY OF THE INVENTION

A common material used in rifle bore bullets is lead that most often is enclosed by a jacket made from a copper-zinc alloy or from plated steel. The jacket provides protection for the soft lead core against corrosion and external deformation. However, the jacket must allow for a smooth firing at the high muzzle velocities associated with modern firearms. At these high velocities, a bullet that is not enclosed by a jacket would deposit lead in the barrel bore of the fire arm due to friction heat. Deposits of lead in the barrel bore may cause the bullet to slip within the bore during ejection therethrough and in the worst case the lead deposits may cause the barrel bore to burst. Another drawback of slippage in the bore is that the bullets tend to tumble, as a result of insufficient rotational speed, during the flight which reduces the accuracy of hitting a target.

Furthermore, in game hunting, the jacket improves the effectiveness of a conventional bullet because the jacket preserves the shape of the lead core as the bullet penetrates an animal and thereby enables a desired deep penetration of the bullet. However, a deep penetration is often of little importance in the field of practice and contest shooting.

A conventional jacketed lead bullet is manufactured through several steps. Jacket blanks are punched from a jacket plate and formed to a sleeve through two or more form pressing operations. The lead core, sometimes with antimony added thereto to increase the hardness of the lead core, is draw formed through tapered bores to obtain the accurate gauge of the lead core. The lead core is then cold formed to snugly fit within a surrounding jacket. In a joining operation, the lead core is mounted within the jacket. A close fit between the lead core and the jacket is of utmost importance since the formation of air pockets therebetween would result in an un-balanced bullet leading to poor shooting results. In the joining operation, multiple tools are used, generally up to six tools, between which the lead core and jackets are moved. In a final operation, the completed bullet is controlled to check the accuracy of, for example, the gauge and weight of the bullet.

Jacketed lead bullets are available in multiple embodiments. However, they all have in common that the varied shapes of particularly the jackets are designed to increase the effectiveness and ability of the bullets to penetrate game animals. Most of the ammunition for firearms that are made are used for practice and contest shooting so that features of the bullets to effectively kill an animal are not important. Ammunition designed for game hunting are sometimes used in target shooting for the purpose of adjusting the sight equipment of the hunting rifle and the range thereof. However, game ammunition is only a small part of the total amount of ammunition used in practice and target shooting. It is estimated that one manufacturer of small arms ammunition alone distributes about five million cartridges annually for target shooting. Knowing that as much as 90–95% of the total weight of each bullet is lead, one may readily realize that considerable amounts of this toxic metal is polluting the environment and that measures directed to limiting and reducing this pollution is of utmost importance.

For smooth barrel guns (shotguns), there are alternatives to lead bullets available on the market although lead bullets are still the most common bullet used. For rifles and hand guns, however, no lead free bullets are known to be available on the market that meet the users requirements of high performance and low selling price.

Another drawback of conventional bullets, when used in target shooting, is that the bullets, upon perforation of the target, produces a ripped hole with blurred edges. The blurred edges often lead to difficult interpretations and drill gauges are required to determine which target ring was hit.

It is therefore an object of the present invention to provide a small arms projectile having a minimum lead content.

It is a further object to provide a small arms projectile having a low selling price compared to conventional jacketed lead bullets, by using a simplified manufacturing process.

It is also an object to provide a projectile that is suitable for target shooting.

Another object is to provide a small arms projectile having a shape that produces a hole having sharp and clean edges upon penetration of a target.

The present invention is a bullet made from a steel alloy containing tellurium. The bullet is virtually lead free making it environmentally safe. The tellurium in combination with a small amount of lead provides a steel alloy having good machinability and lubrication properties, thus reducing frictional wear inside a rigid bore when the bullet is ejected therethrough. The steel alloy is sufficiently soft to prevent any damage of the lands and grooves disposed within the rifle bore when the bullet is propelled through the rifle bore. Additionally, an anticorrosive coating may be applied on the bullet. The coating may comprise a metal selected from the group consisting of copper, zinc and nickel. Preferably, the steel alloy is at least as hard as or harder than the anticorrosive coating of copper that may be coated on the bullet body. A lubricating coating such as polytetrafluoroethylene or molybdenumdisulfide may also be applied on top of the anticorrosive coating.

DETAILED DESCRIPTION

Figure 1:
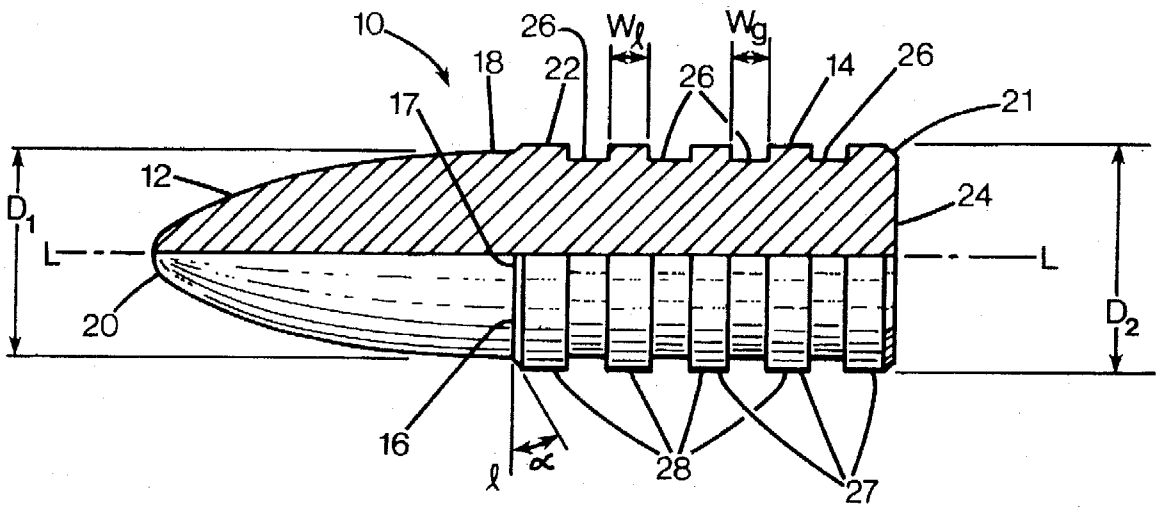
FIG. 1 is a side view of an embodiment of the projectile of the present invention.

FIG. 1 shows a soft steel projectile or bullet 10 according to a preferred embodiment of the present invention. The bullet has a torpedo or nose section 12 and a guide section 14 that is connected to the nose section at a transition section 16. The nose section has a diameter D1, at a cylindrical shaped base portion 18, that is gradually reduced to a pointed but dull nose portion 20. It is to be understood that the nose section may have a variety of shapes, including but not limited to, hollow or ogive points and the nose edge 20 may be flat or round.

The guide section 14, including a cylindrical shaped outer surfaces 22, has one end terminating at a substantially flat tail end portion 24 via a chamfered rear edge 21. In this way, end portion 24 is opposite nose portion 20 of nose section 12. Outer surfaces 22 have spaced apart circumferential grooves 26 defined therein so that peripheral and protruding rectangular shaped lands 28 are formed between the grooves. The outer surfaces 22 have a diameter D2 that is slightly greater than the diameter D1 of the base section 18 so that the outer surface 22 and the base portion 18 are connected by the slanting transition surface 16.

The lands 28 provide a tight seal between bullet 10 and a rifle bore (not shown) to prevent powder combustion gases, generated when the bullet is fired, from escaping therebetween. The grooves are provided to permit the lands 28 of the projectile, that are deformed and compressed by the lands of the barrel bore, to expand into the grooves 26 so that the diameter $D_2$ of the guide section 14 is adapted to the inner diameter of the gun barrel bore. This deformation occurs when the projectile is fired and propelled through the barrel bore, as described in detail below.

In the first preferred embodiment of the present invention, one of the lands 28 of the bullet 10 is disposed immediately adjacent transition section 16. The transition section 16 preferably includes a forwardly slanting front face 17 forming an angle $\alpha$ relative to a vertical axis 1 perpendicular to a longitudinal axis L. The angle $\alpha$ may be about 25°–35° but is preferably about 30° relative to the vertical axis 1. Other angles are also possible and the shape of bullet 10 may have a variety of shapes to meet the specific requirements of penetration ability and stopping effect.

It is important that the steel alloy of the bullet 10 is sufficiently soft to prevent any damage to the rifle bore during the deformation process of the lands 28 of the bullet. If an anticorrosive coating 27 such as copper is applied on the outer surface 22, it is preferable that the steel alloy of the bullet 10 has a hardness value that is higher than the hardness value of the anti-corrosive coating. It has been found that the carbon content of the steel alloy should not exceed 0.40% by weight. More preferably, the carbon content should not exceed about 0.14% by weight when copper is used as a coating. A carbon content higher than about 0.14% could make the steel alloy too hard which could damage the rifle bore when the bullet is ejected therethrough. The requirement of having a steel alloy body that is harder than the anticorrosive coating is important because the lands of the rifle bore penetrates through the anticorrosive coating when the bullet is ejected through the rifle bore due to the tight dimensions between the bullet 10 and the rifle bore.

The layer 27 may contain copper or an alloy including copper. This layer may be applied electrolytically so as to carefully control the thickness of the layer. This layer should preferably be as thin as possible. In the preferred embodiment, this layer should be from about 0.005 millimeter to about 0.1 millimeter. More preferably, the thickness should range from about 0.008 millimeter to about 0.020 millimeter to provide the bullet with sufficient corrosive protection. Most preferably, the thickness of the coating should be from about 0.010 millimeter to about 0.015 millimeter or about 10–15 microns. In comparison, a conventional copper jacket typically has a thickness of about 0.3 millimeter. The jacket of a conventional bullet often functions to prevent the lead inside the jacket from coming into contact with the inside of the barrel bore which could cause an explosion of the barrel bore if enough lead has previously been caught in the bore by deposits from earlier bullets. The jacket of a conventional lead bullet also provides the bullet with added stability during the propulsion of the bullet through the barrel bore.

In contrast to a conventional bullet design having a thick protective jacket, the bullet 10 of the present invention utilizes a very thin copper coating to enable lands 106 (see FIGS. 2 and 3) of a barrel bore 102, defined in a barrel 100, to penetrate through the layer 27 to deform the lands 28 and engage the grooves 26 of the bullet 10. The high machinability of the steel alloy containing tellurium and lead enables the barrel bore 102 to deform the lands of the bullet 10 to tightly engage and guide the lands 28 of the bullet 10 through the helical grooves of the bore to spin the bullet during the rapid discharge of the bullet through the barrel 100. The high machinability of the steel alloy of the present invention is such that the contact between the bullet 10 and the lands 106 of the barrel bore 102 does not destroy or unnecessarily wear the lands 106 of the barrel bore.

On the other hand, the steel alloy is of a sufficient hardness to provide sufficient rigidity to the bullet 10 without destroying the lands 106 of the barrel bore 102. A conventional lead bullet, without the protection of a jacket, would be completely deformed and destroyed by the lands of the barrel bore due to the softness of lead. A lead bullet softens and expands to provide a gas tight seal between the bullet and the bore at the firing moment due to the high temperature. This expansion of the lead bullet reduces the muzzle speed of the lead bullet. The tellurium based steel alloy bullet of the present invention is sufficiently temperature resistant to enable an efficient discharge of the projectile while permitting the lands 106 of the bore 102 to engage the bullet 10 without destroying the bullet 10 or the helical lands 106 of the barrel bore.

Figure 2:
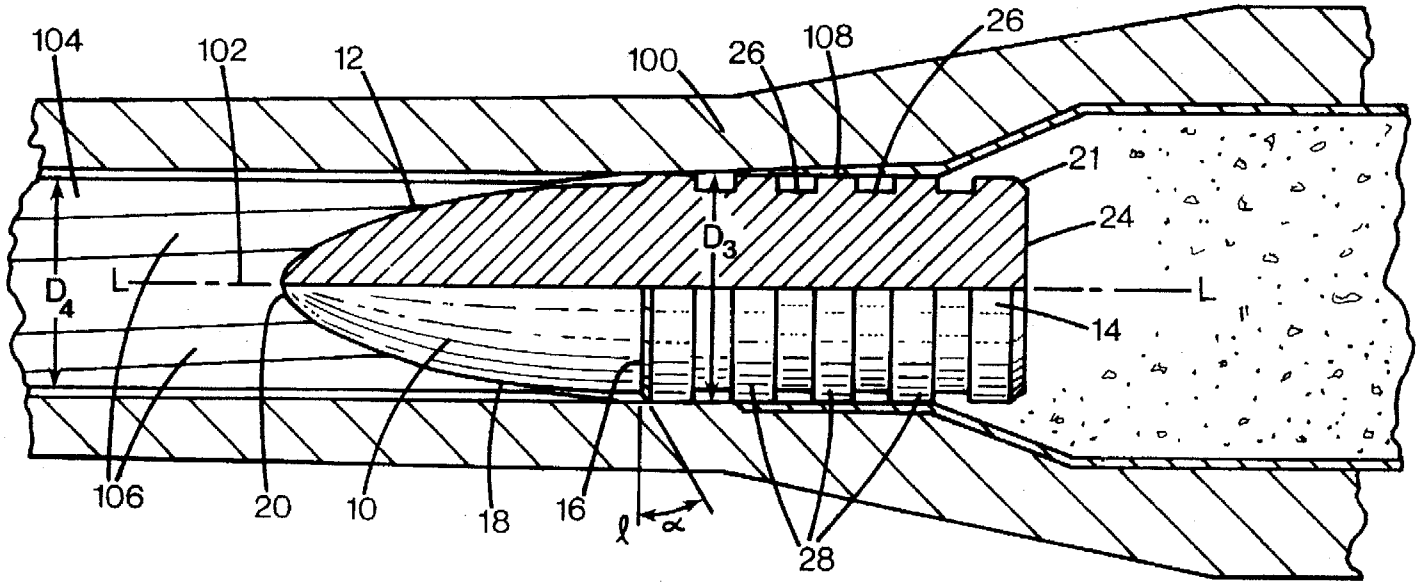
FIG. 2 is a side view of the projectile of FIG. 1 disposed in a barrel.

FIG. 2 shows the bullet 10 placed inside the barrel 100 having the bore 102 defined therethrough. The barrel 100 has an inside wall 104 defining the bore. The inside wall 104 has longitudinal and helical lands 106 extending along the inside wall 104. The lands 106 of the barrel bore are usually about 2 millimeter wide and about 0.1 millimeter high. Due to the spiral form of the lands 106, the lands may extend into the grooves 26 of the bullet 10 and engage the bullet to cause the bullet to spin or rotate in the barrel bore 102. This rotation stabilizes the flight of the bullet. The end of the barrel that is attached to the gun itself (not shown) has a section 108 at the inner wall 104 that has a smooth surface and does not have any lands disposed thereon. Because this section does not have any lands, an inner diameter $D_3$ of this section is slightly greater than a diameter $D_4$ of the land portion of the barrel extending all the way to the muzzle (not shown).

The bullet 10 preferably is solid and manufactured from a steel alloy having a low carbon (C) content. The preferred embodiment also includes some tellurium (Te) and lead (Pb) to improve the machinability or cutting capacity of the steel alloy.

The steel alloy of the present invention contains tellurium in an amount no greater than one percent by weight. More preferably, the tellurium content is not greater than about 0.1 percent by weight. Most preferably, the tellurium content is from about 0.02 to about 0.04 percent by weight.

In the preferred embodiment, the steel alloy has a lead content not exceeding one percent by weight. More preferably, the amount of lead is from about 0.15 to about 0.35 percent by weight. Most preferably, the lead content of the steel alloy is about 0.25 percent by weight. For comparison, the cutting capacity index or machinability index for standard machine-steel is 100 (DIN 9SMn23 or SS 1912) and the tellurium/lead containing steel alloy of the present invention has an index of about 150.

The inclusion of lead and tellurium in the steel alloy thus improves the machinability of the steel alloy of the bullet of the present invention. Improved machinability is an important feature because the lands 28 of the bullet are axially deformed or shifted by the helical lands of the barrel when the bullet is ejected therethrough, as explained in detail below.

The bullet of the present invention takes advantage of the high machinability of steel alloy containing a small amount of tellurium and lead. The bullet may be turned in a lathe to reduce the manufacturing costs so the bullet has a competitive selling price. A preferred method of machining the bullet is through plastic forming methods.

The lubricating effect of tellurium minimizes the amounts of lead required and produces a bullet material that does not damage the rifle bore upon passage of the bullet therethrough. It is believed that the high temperature fumes developed during the discharge process of the bullet is more damaging to the bore, especially the section thereof that is exposed to the fumes during the free flight of the bullet, than the friction wear exerted upon the rifle bore by the jacket of the bullets made of copper or steel. The largest inner diameter of the barrel bore is at the breech-block so that a small gap is defined between the bullet and the rifle bore when the cartridge containing the bullet is seated and prepared for firing. Upon firing, the bullet travels a very short distance within the barrel bore without much guidance by the inner wall of the barrel until the lands of the barrel engage the grooves 26 of the bullet 10.

Due to the high pressure developed at the moment of firing, a conventional lead bullet, which is relatively soft, tends to be substantially deformed. However, this is not the case with the bullet 10 of the present invention which as a result of the harder core material of the bullet travels more efficiently within the rifle bore without being substantially deformed. The steel alloy may have a hardness, after cold drawing of approximately 210 Brinell (HB) which may be reduced, if desired, to approximately 110–120 HB by subjecting the steel alloy to about 730 degrees Celsius. The carbon content should be less than about 0.40% by weight of the steel alloy. Most preferably, the carbon content should be less than 0.14%.

The lead in the steel alloy bullet 10 of the present invention may be found in the structure as elongated stringer-like inclusions. The tellurium cooperates with the lead so that the tellurium only appears in the stringer-like inclusions of lead but not as glob-like inclusion. Accordingly, when tellurium is added to the steel alloy together with lead, both materials are distributed in the most effective manner from the standpoint of being intercepted by the helical lands 106 disposed in the barrel 100. In other words, the distribution of tellurium and lead in the steel alloy is such that the steel alloy permits penetration by the lands 106 of the barrel without destroying the barrel 100 or the bullet 10. In addition, the combination of lead and tellurium seems to impart a chip breaking property to the stringers already having the lubricating properties normally associated with stringers containing lead.

Figure 3:
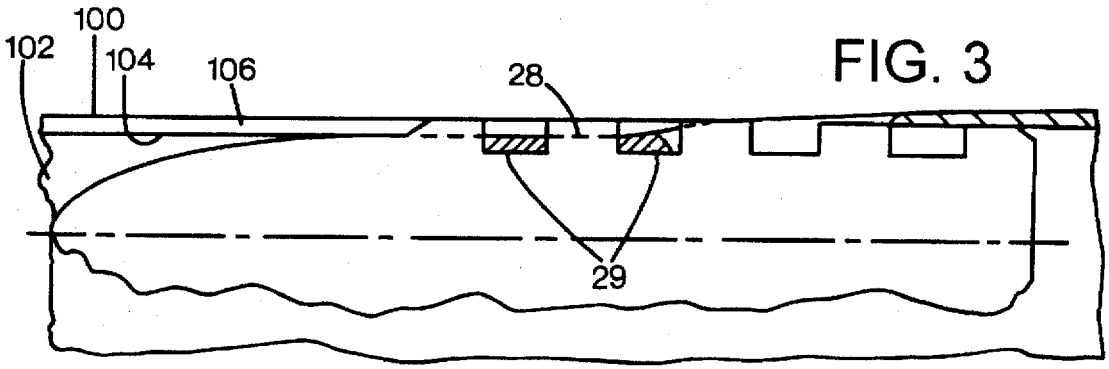
FIG. 3 is an enlarged view of the projectile of FIG. 2 showing the projectile in engagement with the barrel.

As mentioned earlier, it is important that the bullet 10 tightly fits within the barrel bore 102 without damaging or unduly wearing the helical grooves and lands 106 extending in the barrel bore 102. Therefore, the outer diameter of the projectile corresponds to the inner diameter of the barrel bore. In the preferred embodiment, the diameter D2 of the bullet 10 is about 7.82 millimeter and the diameter D4 of the barrel bore is about 7.62 millimeter. Because the outer diameter of the bullet 10 is greater than the inner diameter of the barrel bore 102, the lands 106 deforms the lands 28 of the bullet 10 and forces the bullet 10 to rotate as the bullet is propelled through the bore 102. The consistent rotation of the bullet 10 improves the accuracy and flight characteristics of the projectile. The surface material of the lands 28 of the bullet 10 that is deformed by the lands 106 of the barrel is permitted to flow or be shifted into the grooves 26 defined in the guide section 14 of the bullet 10 as shown in FIG. 3. In a conventional bullet having a smooth outer surface, the rotation is not as consistent because the lands of the barrel bore may penetrate the copper of the jacket differently and is more likely to slip occasionally.

One purpose of the grooves 26 of the bullet 10 is thus to receive the deformed material 29 from the lands 28 of the bullet 10 that is forced out of its place by the lands 106 of the barrel bore 100. It is desirable to make the grooves wide enough to be able to receive the land material 29. However, it is also important to design the bullet 10 so that it may be properly guided through the barrel bore while the guide section 14 of the bullet 10 has been deformed by the lands 106 of the barrel bore 102 that are permitted to penetrate through the anticorrosive coating to deform the guide section. The penetration and deformation of the lands are performed without adversely affect the shape of the lands 106. It is particularly important that the nose section 20 of the bullet 10 follows an imaginary longitudinal axis L of the barrel bore 102 and that the bullet is free from deviations from this axis. Another consideration is to design the grooves 26 of the bullets so that the air resistance is minimized during flight and that the bullet 10 fits tightly within the barrel bore to prevent gases from escaping between the bullet and the barrel.

The bullet 10 may travel at a velocity that is at least twice the speed of sound, that is a velocity exceeding 680 meters/second, and is subjected to at least three types of resistance components: wave resistance, base resistance and friction resistance. The wave resistance is the drag that is caused by the over pressure created at the base portion 18 adjacent the front face 17 of the bullet 10. The base resistance is the drag that is created by turbulence behind the tail end 24 of the bullet 10. In general, the wave resistance slows down the bullet 10 more than the base resistance. Because the bullet 10 of the present invention has a grooved guide section 14, the bullet 10 is also subjected to frictional resistance that is caused by over pressure located in the grooves 26 ahead of the lands 28 and under pressure located in the grooves 26 behind the lands 28 of the bullet 10.

In this aspect, the machinability of the tellurium/lead containing steel alloy is critical. The steel alloy must not be too hard which may damage the barrel 100. On the other hand, the steel alloy must not be too soft because the bullet 10 may then be so deformed by the lands 106 of the barrel 100 that the flight characteristics of the bullet would be unacceptable. Tellurium has shown to be particularly useful as a component in the steel alloy because tellurium tends to congregate to the surface of the steel alloy so that it is possible to take full advantage of the properties of tellurium, such as high ability to be deformed without cracking and good lubrication properties.

Tests and calculations have shown that grooves and lands having a substantially square or rectangular shape (see FIG. 1) should have the same length/width, as measured in the direction of the longitudinal axis of the projectile, to minimize the friction resistance caused by the grooved guide section 14. In other words, a width $W_1$ of the lands 28 should be the same as a width $W_g$ of the grooves 26 disposed therebetween.

To ensure that the bullet 10 is properly guided by the lands 106 of the barrel bore 102 when the bullet is fired in a rifle, the bullet 10 must be long enough so that the lands 106 of the barrel bore 102 may engage the lands 28 of the bullet (best shown in FIG. 3) before the throat of the cartridge loses contact with the tail end 24 of the bullet 10. Because the bullet 10 of the present invention is made of a steel alloy that has a density that is substantially lower than the density of lead, it is also advantageous to make the projectile as long as possible to add weight to the projectile which affects the impact energy and reduces the air friction of the bullet 10 during the flight thereof.

Regarding the guiding function of the barrel bore 102, the lands 106 of the bore 102 should engage at least two grooves 26 of the bullet 10 before the throat of the cartridge is released from the tail end 24 of the bullet 10 at the moment of firing. The first groove 26 that is engaged by the barrel bore 102 may be the groove 26 that is adjacent the base section 18 of the bullet 10.

The grooves 26 of the bullet 10 should be as shallow as possible to reduce the risk of unnecessary turbulence during the flight of the bullet 10. As mentioned earlier, however, the grooves 26 must be sufficiently deep and wide to accommodate the deformed land material 29 that is forced or axially shifted into the grooves 26 by the lands 106 of the barrel bore 102. Because the lands 28 of the bullet 10 are forced backwardly during firing, the groove 26 that is positioned behind the land 28 receives the deformed land material 29. The depth of the grooves is preferably about twice as deep as the height of the lands 106, that is about 0.2 millimeter if the height of the lands is 0.1 millimeter when the lands and grooves have a rectangular cross section and have the same width.

The bullet 10 of the present invention may be made by machining a bar in a lathe and thereafter cutting off the bullets from the bar. The bullets 10 may have a diameter that is slightly smaller than the inner diameter of the rifle gauge to permit a coating to be applied to the outside surface of the bullets. The coating may be an antioxidant compound, such as copper, zinc, nickel or a composition that includes one or more of these metals and other materials. The coating is preferably applied on the bullet by using a electro-chemical process but may also be applied thereto by using a common jacket blank. The machining of the bullet may be completed within three or four steps in an automatic lathe that is provided with a bar magazine feeder and a tool adapter for several cutters. After machining of the bullet (and in some instances after coating thereof), the bullet is gauged and polished by tumbling the bullet in a fluid. Abrasive materials and detergents may be added to the fluid. A coating is thereafter applied on the bullet. In some instances, a lubrication layer of polytetrafluoroethylene (PTFE) or molybdenumdisulfide is applied on the bullet to further reduce the friction between the bullet and the rifle bore as the bullet is passed through the bore.

In an alternative manufacturing process, the steel alloy of the bullet is subjected to a normalization step to reduce its hardness i.e. when the bullet is made from a cold drawn material. However, the normalization step is not required for the purpose of reducing the friction wear of the rifle bore when a tellurium based steel alloy containing lead is used. The normalization step is often advantageous when other types of steel alloys are used to achieve certain desired properties of the bullet. For example, a softer bullet is more apt to deform upon impact thus transferring its energy to the target (such as an animal).

The projectile or bullet of the present invention has been subjected to several shooting test to evaluate its performance under various conditions.

In a first series of shooting tests, the bullet was machined from a steel alloy including about 0.25 weight percent of lead and 0.04 weight percent of tellurium. The carbon content of the bullet 10 was about 0.07% by weight.

The bullet was coated with a layer of copper having a thickness of about ten microns. Using this steel alloy material, a 6.5 mm caliber bullet of the present invention weighs about 62 grains (4 grams). A conventional jacketed lead bullet having an equivalent caliber would weigh about 80 to 160 gains (5 to 10 grams) depending on the design and purpose of the bullet.

The test shooting verified that the bullet of the present invention, upon being fired in a rifle, reaches a comparatively high muzzle velocity and that the bullet obtains good firing groups on a target.

The test shooting was performed outdoors at noon and with a humidity of about 40%. The weather was slightly clouded with winds ranging from 2–8 meters/second. The shooting distance was 100 meters and the muzzle velocities were measured with a Mod. M1 chronograph. The outdoor test results were compared to a Smith Veston laboratory test performed at the same time.

The bullet of the present invention was loaded with an explosive powder charge of 30 grains (approximately 1.95 grams) and achieved an average muzzle velocity of about 952.4 meters/second in a test series of 10 rounds. A conventional factory loaded jacketed lead bullet was used for comparison that weighed about 93 grains (6 grams) an included a powder charge of 32 grains (approximately 2.1 grams). The jacketed lead bullet reached an average muzzle velocity of about 926.3 meters/second in a test series of 10 rounds, as detailed below:

| Muzzle Velocity (Meters/Second) | | |
|---|---|---|
| | Bullets of the present invention (manually charged) | Conventional lead bullets (factory charged) |
| 1. | 953 | 932 |
| 2. | 945 | 955 |
| 3. | 951 | 911 |
| 4. | 954 | 922 |
| 5. | 953 | 923 |
| 6. | 959 | 930 |
| 7. | 960 | 925 |
| 8. | 942 | 933 |
| 9. | 955 | 912 |
| 10. | 952 | 920 |

To compare the distribution of the firing groups on a target, the respective types of bullets were fired in a series of five of three rounds each. The firing groups of the bullets of the present invention was ranging from about 17 to about 22 millimeters and the firing groups of the conventional jacketed lead bullets were ranging from about 17 to 25 millimeters.

The differences of the firing groups are partially explained by the irregular cross-winds at the time of the shooting test. However, the test results indicate that the bullet of the present invention is suitable for competitive target shooting.

Figure 5:
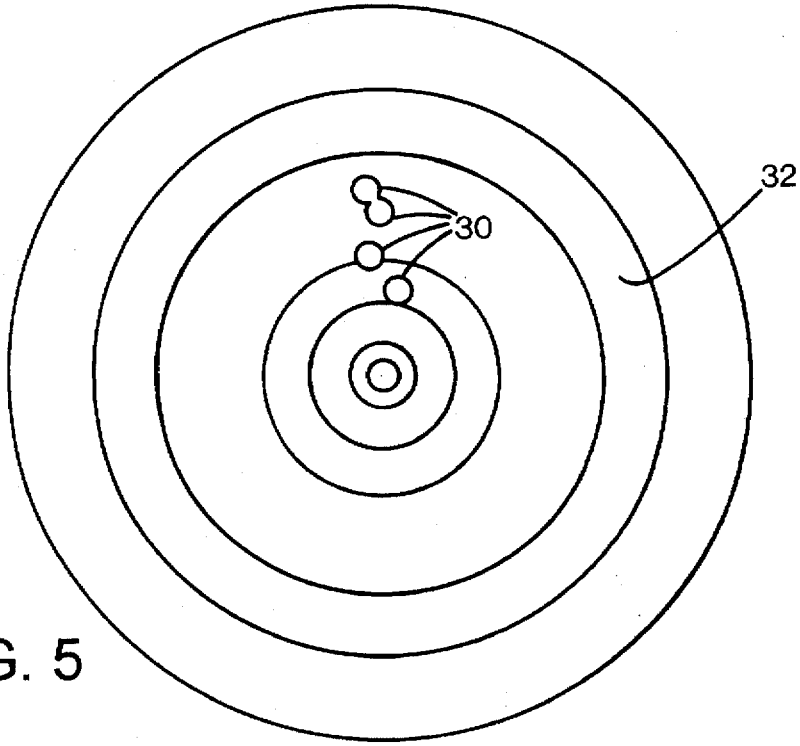
FIG. 5 is a side view of a target having target holes made by the projectile of FIG. 1.
Figure 6:
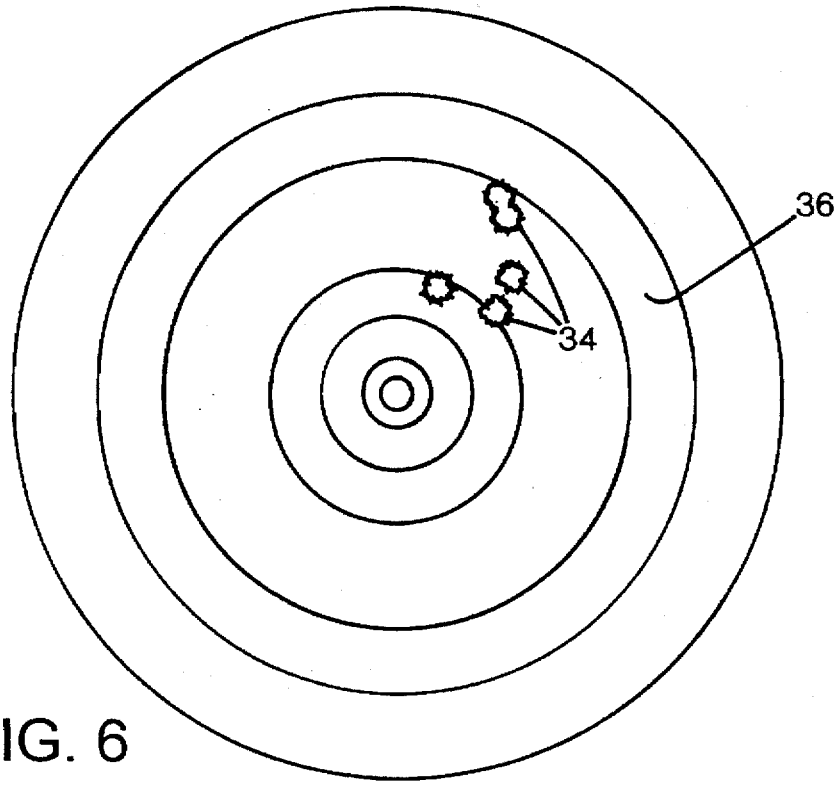
FIG. 6 is a side view of a target having target holes made by a conventional bullet.

The slanted front face 17 of transition section 16 (see FIG. 1) enables bullet 10 to penetrate a target without creating blurred or fuzzy edges of the hole. As seen in FIG. 5, the holes 30 formed in a target 32 by the bullets of the present invention all have clean sharp edges. As seen in FIG. 6, conventional jacketed lead bullets create ripped holes 34 in a target 36 that have blurred and fuzzy edges.

The front face 17 of the bullet of the present invention that was used in the test shooting had a slanting angle $\alpha$ of about 30° relative to a vertical axis 1 of the bullet, as described above. This particular angle is believed to provide the least air resistance and best penetration efficiency. Additionally, the bullet 10, as shown in FIG. 1, provides a bullet that is suitable for target shooting because it creates sharp hit markings on a target as the bullet penetrates the same. Another explanation of the sharp edges that are created by the bullet 10 of the present invention is the fact that the bullet is only partially deformed during firing due to the rigidity of the steel alloy at high temperatures and high gas pressures. The alloy is able to withstand temperatures exceeding 300 degrees Celsius and gas pressures exceeding 3,000 kp/cm$^2$.

Figure 4:
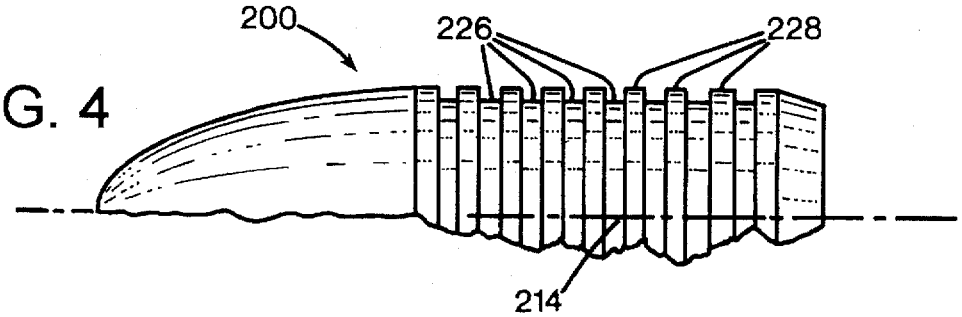
FIG. 4 is a side view of a second embodiment of the projectile of the present invention.

In an alternative embodiment, as shown in FIG. 4, a bullet 200 has a guide section 214 having a large number of grooves 226 and lands 228. It has been found that the number of grooves and lands should be as high as possible so that the width is a small as possible when the shape of the grooves 226 and the lands 228 are rectangular. However, the width of the grooves 226 must be sufficient to receive the land material that is deformed and moved by the barrel bore 102 into the grooves 226 during the propulsion of the bullet 200.

Figure 7:
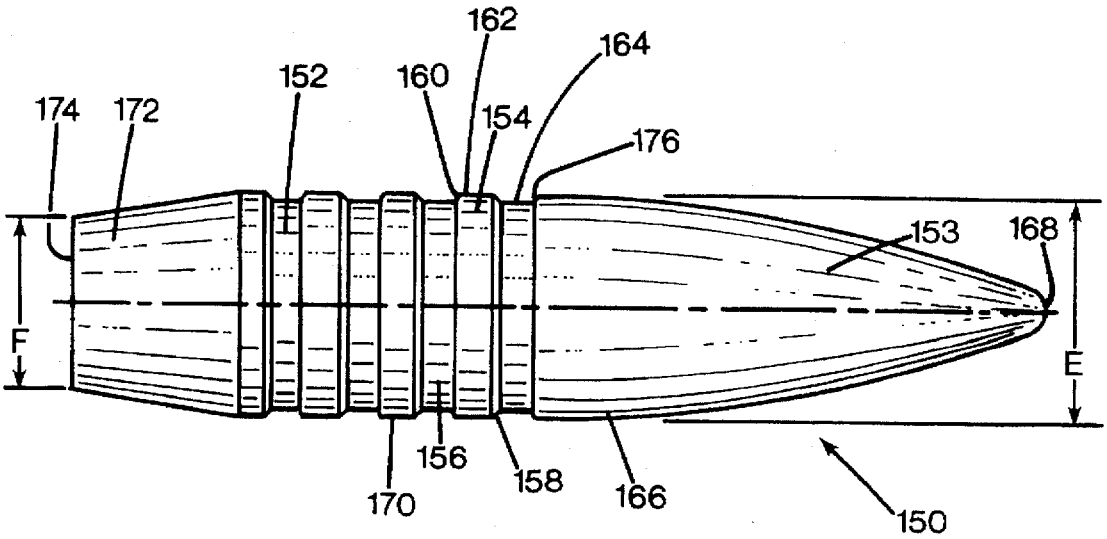
FIG. 7 is a side view of a third embodiment of the projectile of the present invention.

In a second series of shooting tests, a soft steel bullet 150 of a third embodiment of the bullet of the present invention was used, as shown in FIG. 7. The bullet 150 has a guide section 152 and a nose section 153. The guide section 152 includes lands 154 and grooves 156 disposed therebetween. The lands 152 have a chamfered front portion 158 to reduce the frictional resistance that is created during the flight of the bullet 150 due to the over pressure that is created at the chamfered portion 158 of the lands 154. A back side 160 of the land 154 may also be chamfered to reduce the amount of turbulence that is created behind the land 154 which slows down the bullet 150.

The nose section 153 has a diameter E, at a cylindrical shaped base portion 166, that is gradually reduced to a pointed but dull nose edge 168. The guide section 152, including cylindrical shaped outer surfaces 170, has a conical shaped tail end 172 terminating at a substantially flat tail end portion 174. In this way, tail end 172 is opposite nose portion 153. The tail end 172 has a diameter F at the tail end portion 174 that is less than the diameter E. In this embodiment, one of the grooves 156 is immediately adjacent a transition section 176 disposed between the nose section 153 and the guide section 152.

The bullet 150 is preferably made of the same steel alloy as the steel alloy used to make the bullet 10.

The second test shooting was performed to determine the performance of the bullet 150 when used in automatic rifles and machine guns. The test was performed under varying temperature conditions ranging from about −54° to about +52° Celsius. The test results indicate that the bullet 150 of the present invention is superior to conventional bullets. No deposit material was observed in the barrel bores of the firearms after shooting.

Automatic Fire Function Test

| Rounds | Temp (°C.) | Firing rate, rounds/minute |
|---|---|---|
| Ammunition components | | |
| Cartridge: Ordinary 7.62 cartridge with primer | | |
| Powder: NC 1055 p 86030 | | |
| Charge: 45 grains (appr. 2.92 grams). Pressure approx. 340 MPa. | | |
| Projectile: As shown in FIG. 4 and having an overall cartridge length of about 70.7 millimeter, Weight was about 124 grains (8.05 grams). | | |
| Automatic carbine AK4 | | |
| 20 | +21 | 730 (Ref. ammunition) |
| 2 × 20 | +21 | 731 (Bullet of present invention) |
| 20 | −54 | 704 (Bullet of present invention) |
| 20 | +52 | 731 (Bullet of present invention) |
| Machine gun ksp 58 | | |
| 20 | +21 | 670 (Ref. ammunition) |
| 2 × 20 | +21 | 671 (Bullet of present invention) |
| 20 | −54 | 649 (Bullet of present invention) |
| 20 | +52 | 690 (Bullet of present invention) |

At the moment of firing, the bullet 150 is not only exposed to a high temperature, but also to a gas pressure as high as 3,000 kp/cm$^2$ or more which may cause damage to a conventional lead bullet, especially during the free flight of the bullet. Additionally, the bullet 150 is exposed to a temperature of at least 300–400 degrees Celsius. A conventional lead bullet absorbs heat faster than the steel alloy of the present invention and the lead bullet therefore becomes very soft at that temperature. The softness of the conventional lead bullet may lead to a substantial deformation of the shape of the bullet which in turn increases the risk for slippage within the barrel bore. Another drawback is that gas may escape between the lead bullet and the barrel bore and the lead bullet would not be particularly useful for target shooting because the deformed shape of the lead bullet adversely affect the flight performance of the bullet. In contrast, the steel alloy that is used to make the bullets of the present invention is able to withstand a temperature exceeding 300 degrees Celsius and a gas pressure exceeding 3,000 kp/cm$^2$ without being substantially deformed. What is more, the bullet of this invention does not slip within the rifle bore as it passes therethrough in a rotational movement guided by lands disposed within the bore of the rifle. Additionally, the grooves and lands of the bullet of the present invention make the rotation within the barrel more consistent between each bullet fired compared to conventional bullets having a smooth surface.

It is to be understood that many variation of the bullet have been considered. Modifications of the shape of the bullet may be made such as providing an extended guide section or nose section to increase the weight of the bullet or to modify the center of gravity of the body to change the ballistic properties of the bullet.

Furthermore, in game hunting, the nose section may be modified to slow down the bullet upon impact against a living target, e.g. by providing the bullet with a nose portion having a hollow, ogive or flat shape. The coating applied on the body of the bullet could, apart from copper, be composed of zinc, nickel or a compound of lead in combination with these metals and/or polytetrafluoroethylene. A polytetrafluoroethylene coating may be applied to fully encapsulate the bullet or only on the peripheral lands of the guide section so that there is a close fit within the rifle bore and so that there is a section of reduced friction engaging the rifle bore.

As earlier stated, one of the objects of the present invention is to provide a bullet primarily for practice and contest shooting that significantly reduces the deposition of lead into the environment. The amount of lead in the bullet of the present invention is only somewhat more than 1/400 compared to a conventional lead bullet. By using tellurium in the steel alloy, the steel alloy is lubricated so that the rifle bore and its lands are not damaged by the bullets.

During the development process to find a replacement for lead bullets, several other materials than steel alloys containing tellurium have been considered and tested. It is therefore believed that other materials may be used for producing a projectile for small arms. For example, materials used in free-cutting steel materials such as silicon (Si), sulphur (S), phosphorus (P) and manganese (Mn), and, in some cases, the addition of, for example, bismuth (Bi), selenium (Se) or tungsten (W) may be used. These additives may be used to provide specific characteristics of the bullet. For example, an increased amount of phosphorus makes the bullet brittle so that the bullet tends to scatter upon impact on solid targets such as metal, stone, concrete, brick wall etc., leaving only minor or no ricochets.

The addition of tungsten increases the ability of the bullet to penetrate a target. However, a bullet made from a steel alloy containing tellurium together with lead provides an advantageous lubrication effect when the bullet passes through the rifle bore and when the body of the bullet is machined. This makes tellurium containing machine steel an extremely suitable material for bullets.

Figure 8:
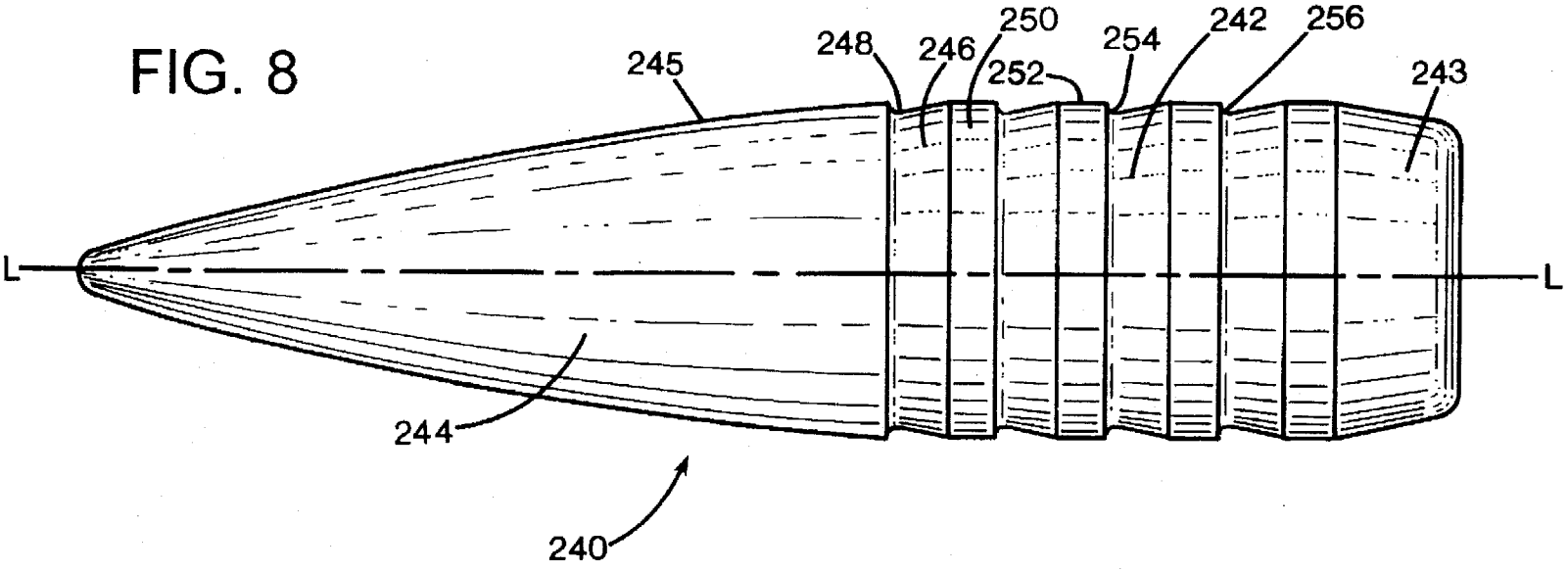
FIG. 8 is a side view of a fourth embodiment of the projectile of the present invention.

FIG. 8 shows an alternative embodiment of a bullet 240 of the present invention. The bullet 240 has a guide section 242 attached to a nose section 244. The nose section has a slightly curved outer surface 245. A chamfered tail end 243 is attached to the guide section 242. The guide section 242 has a plurality of circumferential grooves 246 defined therein. The grooves have bottom surfaces 248 that are slanted relative to a longitudinal axis L of the bullet and are substantially parallel to the outer surface 245 of the nose section 244. Lands 250 are disposed between the grooves 246. The lands 250 have outer surfaces 252 that are substantially parallel to the longitudinal axis L of the bullet 240. The lands 250 have a back side 254 that is perpendicular to the outer surface 252. A radius portion 256 having a radius R is disposed between the back side 254 and the bottom surface 248. The radius portion R not only reduces the air friction but also reduces the risk of crack propagation in the bullet 240. The radius portion R may also be used on rectangular shaped lands and chamfered lands.

Figure 9:
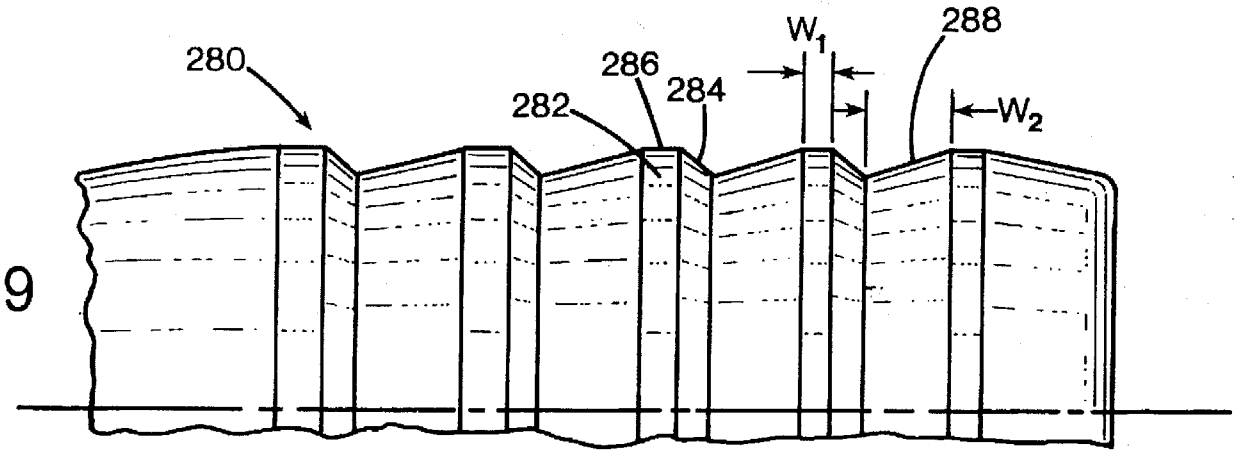
FIG. 9 is a side view of a portion of a fifth embodiment of the projectile of the present invention.

FIG. 9 shows a bullet 280 that is similar to the bullet 240. However, the bullet 280 has chamfered lands 282 including a back side 284 that is slanted relative to a upper surface 286 of the land 282. By chamfering the lands 282, the average depth of the grooves 288 is reduced. However, the reduced depth is compensated for by widening the grooves 288 so that the grooves are wider than an upper flat surface 282 of the lands 282 to ensure that the grooves 288 can accommodate the land material that is deformed by the lands of the barrel bore. Thus, the upper surface 286 has a width $W_1$ that is substantially smaller than the width $W_2$ of a groove 288.

In this disclosure the bullet of the present invention have been described as a projectile primarily intended for rifle bores. However, this does not exclude the use of tellurium in steel alloys for projectiles intended for smooth barrel guns and for producing round shots.

While the present invention has been described in accordance with preferred embodiments, it is to be understood that certain substitutions and alterations may be made thereto without departing from the spirit and scope of the following claims.

What is claimed is:

1. A small arms projectile comprising:

an elongate solid body made of a steel alloy;

the steel alloy containing from about 0.02 to about 0.04 percent by weight of tellurium and less than about 0.14 percent by weight of carbon;

the elongate solid body comprising:

a nose section, and a guide section attached to the nose section, the guide section having circumferential rectangular grooves defined therein and circumferential rectangular lands disposed therebetween, the guide section having an anticorrosive coating applied thereon, the anticorrosive coating having a thickness from about 0.005 to about 0.1 millimeter, the circumferential rectangular lands having a first width and the circumferential rectangular grooves including a bottom surface having a second width, the first width being substantially equal to the second width.

2. A projectile according to claim 1 wherein the steel alloy contains lead and the lead content is from about 0.15 to about 0.35 percent by weight.

3. A projectile according to claim 1 wherein the anticorrosive coating comprises a metal selected from the group consisting of copper, zinc and nickel.

4. A projectile according to claim 1 wherein the anticorrosive coating comprises polytetrafluoroethylene.

5. A projectile according to claim 1 wherein an intermediate section is disposed between the nose section and the guide section, the intermediate section having a slanting front face, the front face forming an angle $\alpha$ relative to a vertical axis of the solid body, the vertical axis being perpendicular to a longitudinal axis of the solid body, the angle $\alpha$ ranging from about 25° to about 35°.

6. A projectile according to claim 5 wherein the angle $\alpha$ is about 30°.

7. A projectile according to claim 1 wherein the nose section has a dull outer nose portion.

8. A projectile according to claim 1 wherein the steel body has a hardness value of about 110 Brinell.

9. A projectile according to claim 1 wherein the thickness of the anticorrosive coating is from about 0.010 to about 0.015 millimeter.

10. A small arms projectile comprising:

a solid body made of a steel alloy;

the steel alloy containing from about 0.02 to about 0.04 percent by weight of tellurium and less than about 0.14 percent by weight of carbon;

the solid body comprising:

a nose section, and a guide section attached to the nose section, the guide section having circumferential rectangular grooves defined therein and circumferential rectangular lands disposed therebetween, the solid body being insertable into a barrel defining a barrel bore, the solid body having a first diameter, the barrel having a helical land extending therethrough and defining a second inner diameter, the first diameter being greater than the second diameter, the circumferential rectangular grooves including a bottom surface having a first width and the circumferential rectangular lands having a second width, the first width being substantially equal to the second width, an anticorrosive coating on the solid body, the anticorrosive coating having a thickness of between about 0.005 millimeter and about 0.1 millimeter, and the land of the barrel having a hardness value that is greater than the hardness value of the solid body so that the land of the barrel is permitted to penetrate through the anticorrosive coating to shift a portion of the lands of the solid body into the grooves when the solid body is passed through the barrel bore and guided by the land of the barrel.

11. A small arm projectile comprising:

a solid body made of a steel alloy;

the steel alloy containing from about 0.02 to about 0.04 percent by weight of tellurium, from about 0.15 to about 0.35 percent by weight of lead and less than about 0.14 percent by weight of carbon, the solid body having a hardness value of about 110 Brinell;

the solid body being insertable into a barrel defining a barrel bore, the solid body having a first diameter, the barrel having a helical land extending therethrough so that the barrel bore has a second inner diameter, the first diameter being greater than the second diameter;

the solid body comprising:

a pointed nose section having a diameter;

a guide section attached to the nose section, the guide section having circumferential rectangular grooves defined therein and circumferential rectangular lands disposed therebetween, the guide section having a diameter that is greater than the diameter of the nose section, the grooves being adapted to engage the land disposed in the barrel bore, the circumferential rectangular grooves including a bottom surface having a first width and the circumferential rectangular lands having a second width, the first width being substantially equal to the second width;

an intermediate section disposed between the nose section and the guide section, the intermediate section having a slanting front face, the front face forming an angle $\alpha$ relative to a vertical axis of the solid body, the vertical axis being perpendicular to a longitudinal axis of the solid body, the angle $\alpha$ ranging from about 25° to about 35°; and an anticorrosive coating applied on the solid body, the coating having a thickness of between about 0.010 millimeter and about 0.015 millimeter, the solid body having a hardness value that is greater than a hardness value of the anticorrosive coating, the land of the barrel having a hardness that is greater than the hardness value of the solid body and the anticorrosive coating so that the land of the barrel is permitted to penetrate through the anticorrosive coating to shift a portion of the lands of the solid body into the grooves when the solid body is passed through the barrel bore and guided by the land of the barrel.

* * * * *